United States Patent [19]

Takashiro

[11] 3,983,599

[45] Oct. 5, 1976

[54] TEMPERATURE ACTUATED KEYING DEVICE FOR USE IN AN AUTOMATIC DOOR CLOSING MECHANISM

[75] Inventor: Osamu Takashiro, Osaka, Japan

[73] Assignee: Daihatsu Diesel Mfg. Co., Ltd., Japan

[22] Filed: Apr. 3, 1974

[21] Appl. No.: 457,503

[52] U.S. Cl. ..... 16/48.5; 24/248 L; 49/8

[51] Int. Cl.[2] ..... E05F 15/20

[58] Field of Search ..... 24/248, 248 L, 249 PP, 24/249 R, 230 AT, 230 AV; 49/7, 8; 16/48.5; 160/1, 7, 8, 9

[56] References Cited

UNITED STATES PATENTS

| | | | |
|---|---|---|---|
| 545,049 | 8/1895 | Busse | 49/7 |
| 837,875 | 12/1906 | McKeown | 49/7 |
| 1,563,817 | 12/1925 | Wright | 24/249 PP |
| 1,779,442 | 10/1930 | Mueller | 24/248 SB |
| 2,197,310 | 4/1940 | Lincoln | 24/248 SB X |
| 2,439,132 | 4/1948 | Hatala et al. | 49/7 X |
| 2,887,194 | 5/1959 | Noltin | 49/7 |
| 3,260,018 | 7/1966 | Schuh | 49/7 |
| 3,597,809 | 8/1971 | Crane | 49/8 X |
| 3,761,114 | 9/1973 | Blakeley | 24/249 R X |
| 3,777,422 | 12/1973 | Janssen | 49/7 |

*Primary Examiner*—Philip C. Kannan
*Attorney, Agent, or Firm*—Craig & Antonelli

[57] ABSTRACT

A temperature actuated keying device for use in an automatic door closing mechanism which comprises a pair of thin, long plates for clamping members pivotally connected to each other at overlapping ends thereof by a pin so that both plates can be opened or closed in the same plane relative to the pin as in scissors, a washer portion and a spring provided between the clamping members and a fuse plate consisting of a pair of component plates connected by a fusible material to each other to form the fuse plate which is removably mounted between the other ends of the clamping members. The keying device is attached to a door closing mechanism to hold the door open in normal condition, and to release the door to close in case of emergency when the fusible material melts to separate the fuse plate, thereby opening the keying device.

1 Claim, 45 Drawing Figures

FIG. 25
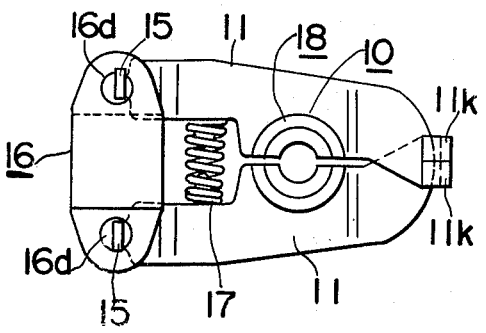
FIG. 27
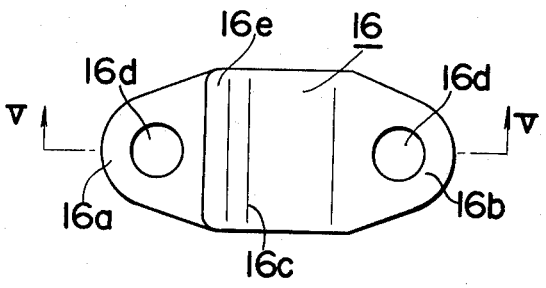
FIG. 26
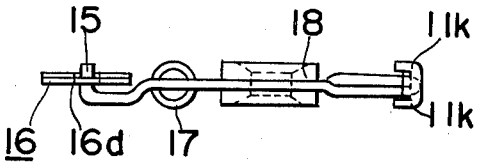
FIG. 28
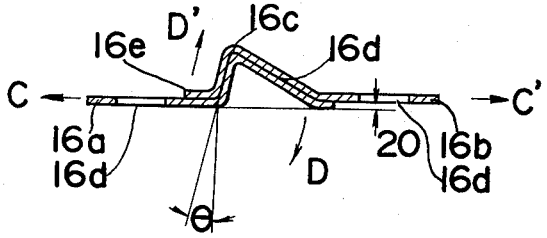
FIG. 31 Tensile test and fusion test of the fuse plate
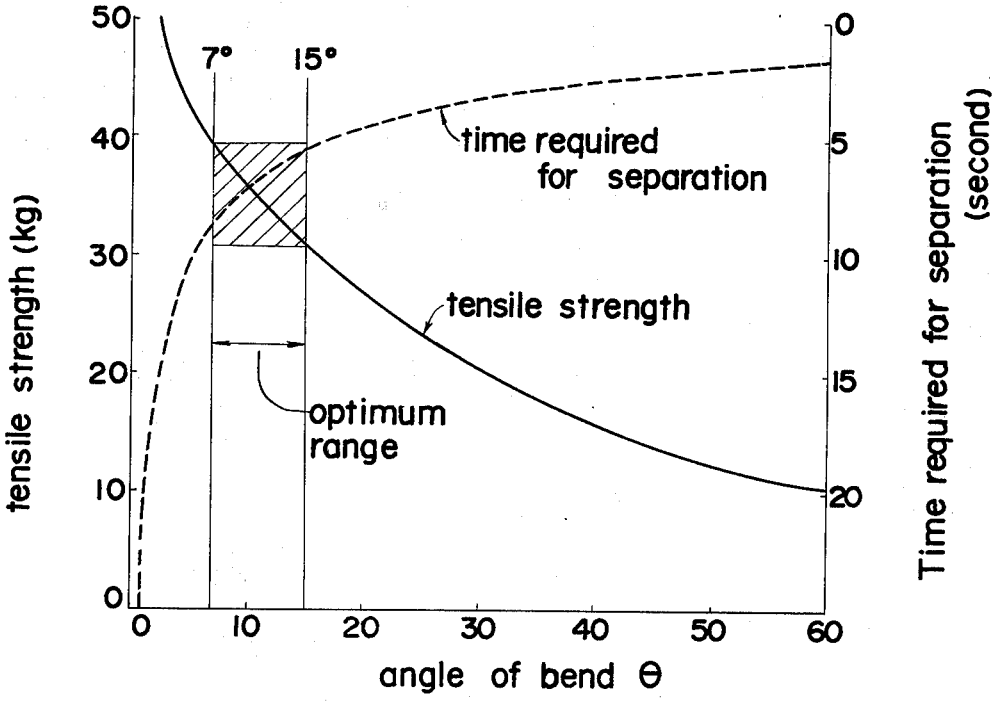
——— tensile strength at 20°C (value at separation limit)
----- separation time at temperatures between 70°C and 75°C with tensile force F of 8kg Sample fuse plate

TEMPERATURE ACTUATED KEYING DEVICE FOR USE IN AN AUTOMATIC DOOR CLOSING MECHANISM

The present invention relates to a temperature actuated keying device, and more particularly to an improved temperature actuated keying device for use in an automatic door closing mechanism which is incorporated into said automatic door closing mechanism so as to hold the door in an fully opened position in normal condition, and to release said door in the direction of closing upon melting of fuse means to open said keying device due to an elevated ambient temperature in case of emergencey.

According to a conventional keying device employed in a door closing mechanism for a similar purpose, a pair of clamping members pivotally connected to each other by a pin at overlapping ends thereof so as to be opened or closed relative to the pin with a countersunk washer portion provided between the plates for attaching the device to a door closing mechanism by a securing screw.

The other ends of the plates are adapted to overlap to a certain extent, whose contact surfaces are soldered by a fusible metal to serve as a fuse in case of a fire. Such a conventional keying device is usually fixed to an arm of a door closer by a countersunk head screw through the countersunk washer and adapted to keep the arm of the door closer and consequently the door in a fully opened position in normal condition. In case of a fire, the fusible metal in the contact surfaces melts so as to open the keying device resulting in loosening between the countersunk head screw and the countersunk washer which causes the arm of the door closer to be released from the fully opened position so as to close the door.

In the conventional keying device of the above construction, the keying device is opened so as to release the door closer only after the fusible metal in its contact surfaces has completely melted and the frictional resistance between the tapered surfaces of the screw head and the countersunk portion of the washer tends to retard the smooth opening of the plates of the keying device, resulting in slow and unstable closing of the door. Furthermore, the keying device cannot be reused as it is lost, upon fusing of the fusible metal, jumping off the securing screw fixing the keying device to the arm of the door closer.

Accordingly, an essential object of the present invention is to provide a keying device with quick and positive reaction in case of emergency, with substantial elmination of the disadvantages inherent in the conventional keying device.

Another important object of the present invention is to provide a keying device of the above described type with a separate fuse plate removably attached thereto so that the keying device can be used repeatedly by replacing the fuse plate.

A further object of the present invention is to provide a keying device of the above described type with a fuse plate which has sufficient tensile strength in normal condition and yet has the easiest fusibility in case of emergency.

A still further object of the present invention is to provide a keying device of the above described type which can be manufactured at low cost with an improvement of performance and durability.

According to a preferred embodiment of the present invention, the keying device has a pair of clamping members of thin, long J-shaped plates pivotally connected to each other at the overlapping round ends thereof by a pin so that both plates can be opened or closed in the same plane relative to the pin as in scissors. When the J-shaped plates are closed relative to the pin, the straight inner edges thereof are adapted to meet in the same plane with a half washer fixed on each of the J-shaped plates forming a countersunk washer at the middle portion of the keying device. The overlapping ends of the J-shaped plates are formed into pointed angular portions extending onto the surfaces of the corresponding plates so that the pointed tips thereof engage step portions formed on the corresponding J-shaped plates to limit the opening of the keying device. The other ends of the J-shaped plates are narrowed to form a U-shaped space between the inner edges of said plates adjacent to the countersunk washer, and the extreme end of each J-shaped plate is further narrowed to form a small rectangular tip which is, bent at right angles to the surface of the J-shaped plate to receive a fuse plate which will be mentioned below. In the facing inner edges of the above U-shaped space between the J-shaped plates projections are formed on the plates to receive ends of a compression spring. The fuse plate for the keying device of the present invention comprises two fuse element plates of D-shape, each formed with a hole at the round end thereof and bent at a portion between the hole and the straight edge thereof to form a triangular portion. The triangular portions on each of the D-shaped plates are adapted to overlap each other with contact surfaces thereof soldered by a fusible material so that the two D-shaped plates soldered together form a single fuse plate. The angle of bend of the above fuse plate is selected to be one suitable for the easiest separation into two component plates upon melting of the fusible material in case of a fire, and yet having sufficient tensile strength in the normal condition where the door is kept in a fully opened position. In mounting the above fuse plate on the keying device of the present invention, the fuse plate is inserted into the bent rectangular tips of the keying device through the holes at the round ends thereof with the compression spring of the keying device compressed. The keying device with the fuse plate thus mounted is then attached to an arm of a known door closer assembly by a securing screw through the countersunk washer which is preferably sandwiched by a pair of tapered cone washers and through a plate spring.

One end of the plate spring is adapted to engage an upper groove of a pin slidably inserted on a hole formed in the arm of the door closer close to said securing screw. The pin has a small roller at the lower end thereof which is received in a concave groove of a roller support fixed on the door closer. Thus, when the securing screw is tightened to fasten the keying device to the arm of the door closer, the plate spring presses down the pin, and consequently the roller at the lower end thereof, against the concave groove of the roller support and hold the arm in position so as to keep the door in the fully opened position. When the fuse plate is separated into two component plates by the melting of the fusible material due to high ambient temperature in case of a fire, the keying device is opened assisted by the spring force of the compression spring, thus tight contact between the countersunk washer and the tapered cone washers being loosened. Consequently, the downward force of the plate spring pressing down the pin and its roller against the concave groove of the roller support is removed with the pin somewhat raised in the hole. Since the spring force of the door closer always urges the fire door in the direction of closing, the roller support with the concave groove also tends to move in the same direction as the door, and consequently the roller now free from the downward pressure by the plate spring goes over the convex edge of the concave groove, releasing the door from the fully opened position toward the direction of closing.

The provision of a spring in the fuse device is very effective in case of a fire, since as soon as the fusible material of the fuse plate begins to melt by the high ambient temperature, the force of the compression spring always urging to open the keying device pushes open the two clamping plates of the keying device very rapidly without being retarded by the frictional resistance between the tapered portions of the countersunk washer and the tapered cone washers, thus releasing the arm of the door closer to close the fire door rapidly and positively.

Furthermore, since the opening of the keying device is limited by the provision of the step portions on the component plates, the keying device is left on the securing screw through the countersunk washer even after the fuse plate is separated in case of a fire, thus enabling the keying device to be repeatedly used by mere replacing of the fuse plate.

The keying device of the present invention may be used with any other types of fuse plate so long as the fuse plate is one meeting the purpose of the present invention.

It is also possible to apply the keying device of the present invention to any known door closer system which does not depart from the scope of the present invention.

These and other objects and features of the present invention will become apparent from the following description taken in conjunction with the preferred embodiment thereof with reference to the accompanying drawings, in which;

FIG. 1 is a top plan view of the keying device of the invention as applied to a door closer mechanism, FIG. 2 is a cross sectional top plan view of the door closer, FIG. 3 is a cross sectional view taken along the line I—I in FIG. 1, FIG. 4 is a similar view to FIG. 3 with the keying device removed, FIG. 5 is a top plan view, on an enlarged scale, of the keying device of the present invention in one operative position, FIG. 6 is a side elevational view of the keying device in FIG. 5, FIG. 7 is a similar view to FIG. 5, but the device shown in another operative position, FIG. 8 is a top plan view of a 1st modification of the keying device, FIG. 9 is a cross sectional view taken along the line II—II in FIG. 8, FIG. 10 is a top plan view of a 2nd modification of the keying device, FIG. 11 is a top plan view of a 3rd modification of the keying device, FIG. 12 is a side elevational view of a leaf spring applicable to a 4th modification of the keying device, FIG. 13 is a cross sectional view taken along the line III—III in FIG. 12, FIG. 14 is a top plan view of the 4th modification of the keying device, FIG. 15 is a side elevational view of the keying device in FIG. 14, FIG. 16 is a top plan view of a wire spring (a) with cross sections (b) taken along A—A in (a) applicable to a 5th modification of the keying device.

Figure 21:
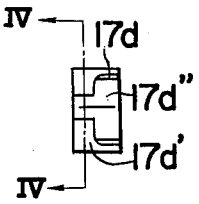
Figure 22:
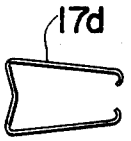
Figure 23:
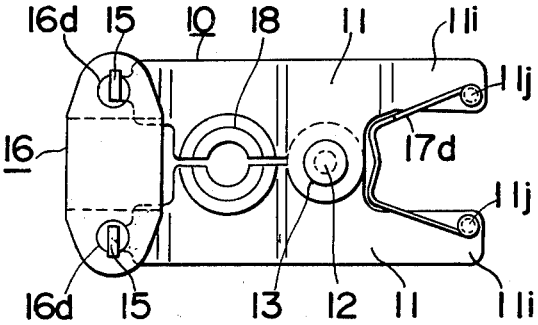
Figure 24:
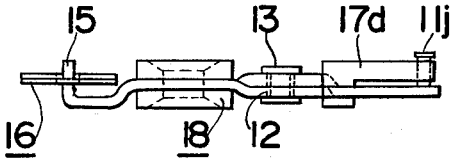
Figure 29:
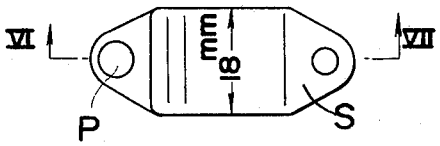
Figure 30:
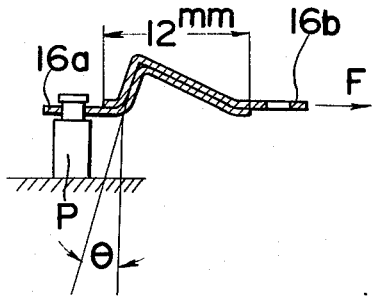
Figure 32:
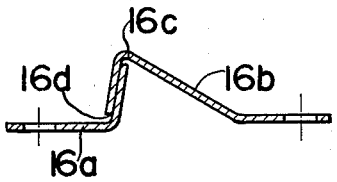
Figure 36:
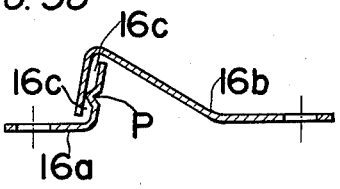
Figure 33:
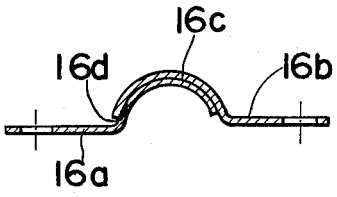
Figure 37:
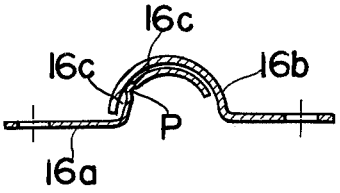
Figure 34:
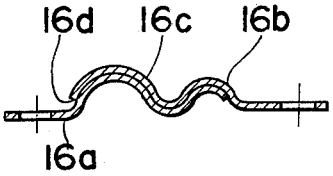
Figure 38:
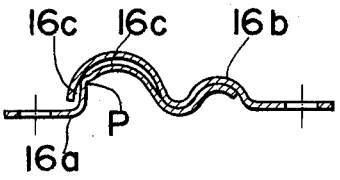
Figure 35:
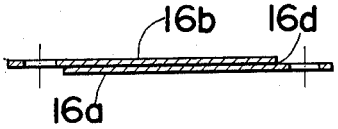
Figure 39:
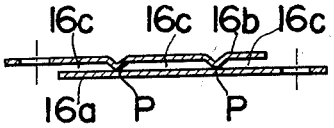
Figure 40:
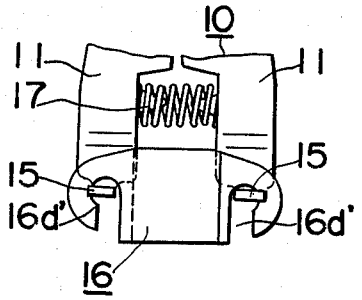
Figure 41:
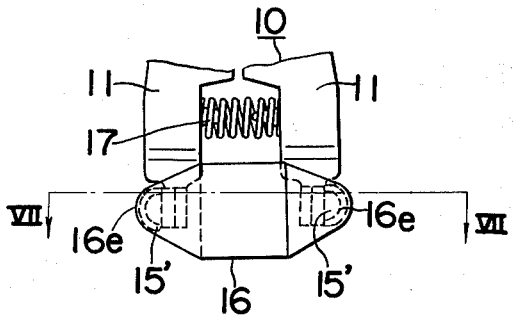
Figure 42:
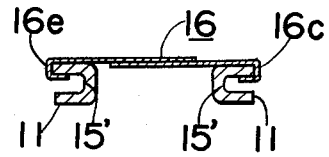
Figure 43:
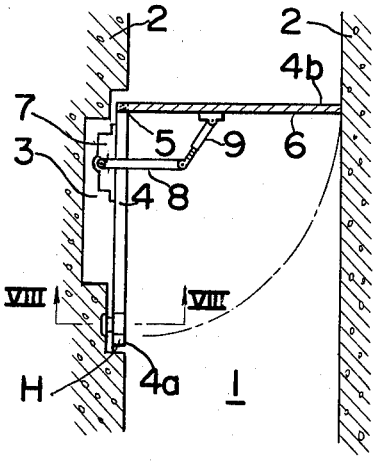
Figure 44:
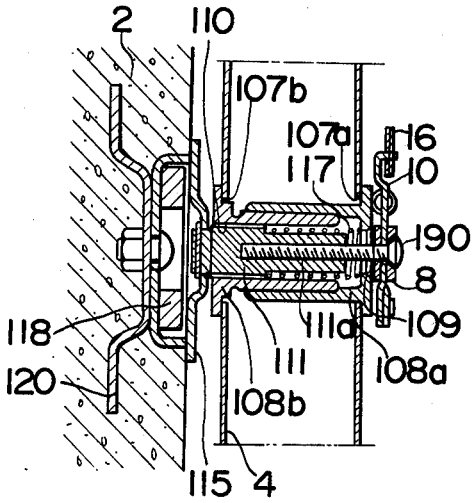
Figure 45:
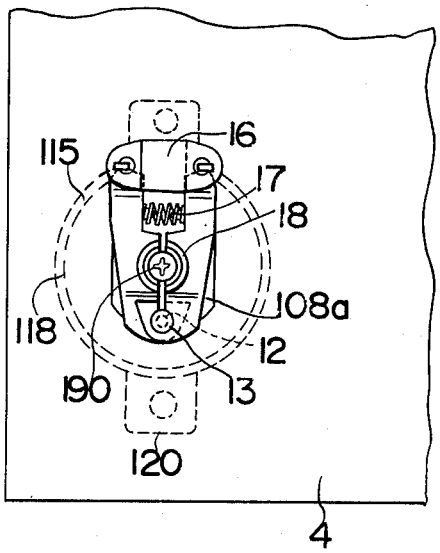

FIG. 21 is a side elevational view of a leaf spring applicable to a 7th modification of the keying device, FIG. 22 is a cross sectional view taken along the line IV—IV in FIG. 21, FIG. 23 is a top plan view of the 7th modification of the keying device, FIG. 24 is a side elevational view of the keying device in FIG. 23, FIG. 25 is a top plan view of an 8th modification of the keying device, FIG. 26 is a side elevational view of the keying device in FIG. 25, FIG. 27 is a top plan view of a fuse plate of the invention, FIG. 28 is a cross sectional view taken along the line V—V in FIG. 27, FIG. 29 is a top plan view of a sample fuse plate for testing, FIG. 30 is a cross sectional view taken along the line VI—VI in FIG. 29, FIG. 31 is a graph showing relations among angle of bend, tensile strength and time required for separation of the fuse plate of the invention, FIG. 32 is a cross sectional view of a 1st modification of the fuse plate, FIG. 33 is a cross sectional view of a 2nd modification of the fuse plate, FIG. 34 is a cross sectional view of a 3rd modification of the fuse plate, FIG. 35 is a cross sectional view of a 4th modification of the fuse plate, FIG. 36 is a cross sectional view of a 5th modification of the fuse plate, FIG. 37 is a cross sectional view of a 6th modification of the fuse plate, FIG. 38 is a cross sectional view of a 7th modification of the fuse plate, FIG. 39 is a cross sectional view of an 8th modification of the fuse plate, FIG. 40 is a top plan view of a 9th modification of the fuse plate as attached to the keying device partly broken away, FIG. 41 is a top plan view of a 10th modification of the fuse plate as attached to the keying device partly broken away, FIG. 42 is a cross sectional view taken along the line VII—VII in FIG. 41, FIG. 43 is a top plan view of a door closer system to which the keying device of the present invention is applicable, FIG. 44 is a cross sectional view taken along the line VIII—VIII in FIG. 43, and FIG. 45 is a top plan view of the keying device of the invention as attached to the door closer mechanism in FIG. 44.

Before the description of the present invention proceeds, it is to be noted that like parts are designated by the like reference numerals throughout the several views of the accompanying drawings.

Referring to FIGS. 1, 2, 3 and 4 the door closer mechanism to which the keying device 10 of the present invention is applicable comprises a door 4 supported by hinges 5 on a wall 2 in a passage 1, a door closer 7 fixed to the upper side of the door 4, an arm 8 pivotally connected at one end thereof to a pinion shaft 7*a* of the door closer 7 by a pin 8*a*, and a link bar 9 pivotally connected at one end thereof to the other end of the arm 8 by a pin 8*b* with the other end of the bar 9 pivotally connected by a pin 9*a* to a bracket 6*a* secured to an upper frame 6 fixed to the wall 2. The door 4 is adapted to rotate 90° relative to the hinge 5 between a fully open position 4*a* adjacent to a door case 3 shown in real line and fully closed position 4*b* below and in line with the stationary upper frame 6 shown in dotted line in FIG. 1. In the arm 8, there is formed a hole 8*c* adjacent to the pin 8*a* into which a pin 23 is slidably inserted. The pin 23 has a groove 23*b* cut in the lower part thereof in the direction of its diameter, in which groove 23*b* a small cylindrical roller 24 is rotatably supported by a pin 24'. The pin 23 has another shallow groove 23*a* formed in the upper surface thereof projecting from the hole 8*c*, which groove 23*a* is cut in the direction parallel to the lower groove 23*b*. A small roller support 25 with a concave groove extending across the width thereof on its surface is fixed on the door closer 7 with the concave groove in parallel to the axis of the roller 24, so that when the door 4 is in the fully opened position 4*a*, the roller 24 of the pin 23 is adapted to be received in the concave groove of the roller support 25. A plate spring 21 of a fish-like shape has a round rivet head 21*b* calked on the under face at one end thereof with the other end cut straight so as to fit in the groove 23*a* of the pin 23, and is formed with a hole 21*a* in the middle portion thereof, the round rivet head 21*b* being loosely received in a dint 8*e* formed in the corresponding position on the arm 8. A hole 8*d* is formed in the arm 8 in a position corresponding to the hole 21*a* of the plate spring 21. A screw 20 is inserted through the hole 8*d* of the arm 8 and the hole 21*a* of the plate spring 21, and held in position with a nut 22.

Figure 2:
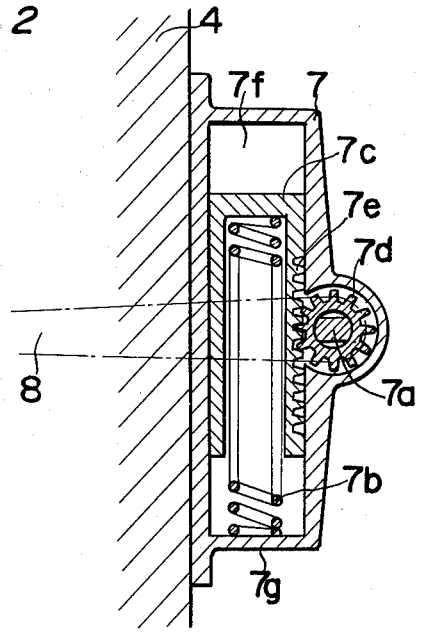

The door closer 7 may be a known construction as in FIG. 2 showing positions of parts when the fire door 4 is fully opened, which comprises a housing 7 suitably secured at the base thereof to the fire door 4 within which a cylinder portion 7*f* is formed. A hollow piston 7*c*, with one end thereof closed, which is shorter than the length of the cylinder 7*f* is slidably provided within the cylinder 7*f* for reciprocation. A coil spring 7*b* is confined between the closed inner end of the piston 7*c* and one end 7*g* of the cylinder 7*f*. The cylinder 7*f* is provided with rack teeth 7*e* on the outer surface in a position facing the pinion 7*d* fixed to the pinion shaft 7*a* which receives one end of the arm 8, the rack teeth 7*e* having mesh relation with the teeth of the pinion 7*d*. Consequently the coil spring 7*b* is compressed when the door is fully opened and the energy thus stored in the spring 7*b* urges the fire door 4 in the direction of closing.

When the securing screw 20 for the keying device 10 is tightened in the above state, the plate spring 21 depresses the pin 23 pressing the roller 24 against the surface of the concave groove of the support 25 on the door closer 7, thus keeping the fire door 7 in the fully opened position 4*a* which is urged to be closed by the force of the spring 7*b* of the door closer 7. If the screw 20 is loosened in this state, the spring force of the plate spring 21 depressing the pin 23 is removed, and the roller 24 of the pin 23 is caused to go over the convex edge of the concave portion of the support 25 so as to close the fire door 7. In this arrangement, the keying device 10 of the present invention is attached between the plate spring 21 and the nut 22 by the securing screw 20 through the countersunk washer 18 in a manner as will be described later.

Figure 6:
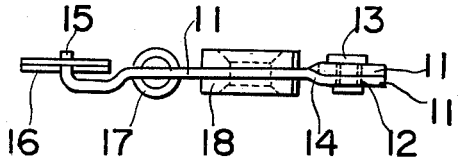
Figure 5:
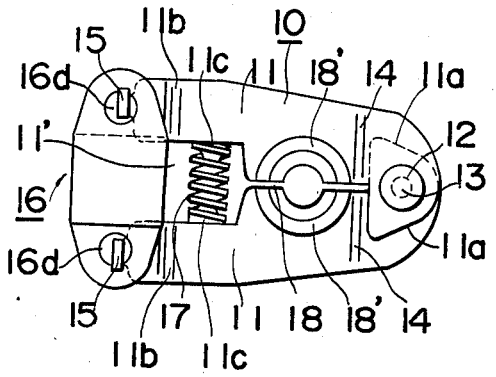
Figure 7:
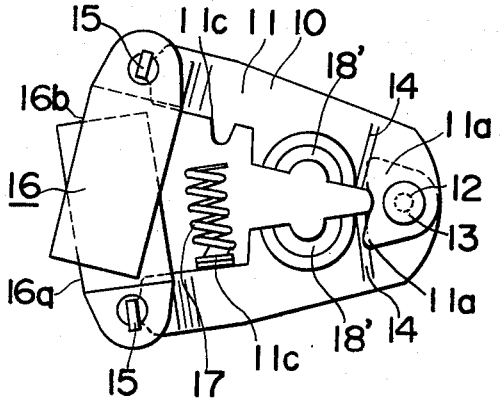

Referring to FIGS. 5 to 7, the keying device 10 of the present invention comprises a pair of clamping members of J-shaped plates 11 pivotally connected to each other at the overlapping round ends thereof by a pin 13 through holes 12 so that both plates 11 can be opened or closed in the same plane relative to the pin 13 as in scissors. When the J-shaped plates 11 are closed relative to the pin 13, the straight inner edges thereof are adapted to join in the same plane with a half washer 18' fixed on each of the J-shaped plates 11 forming a countersunk washer 18 at the middle portion of the keying device 10. The pivoted overlapping ends of the J-shaped plates 11 are further formed into pointed angular portions 11*a* extending onto the surfaces of the corresponding plates 11 so that the pointed tips of the angular portions 11*a* engage step portions 14 formed on the corresponding J-shaped plate 11 to limit the opening of the keying device 10. The other ends of the J-shaped plates 11 are narrowed to form a U-shaped space 11' between the inner edges of the plates 11 adjacent to the countersunk washer 18 and the extreme end of each J-shaped plate 11 is further narrowed to form a small rectangular tip 15 which is bent in the same direction at right angles to the surface of the J-shaped plate 11 to receive a fuse plate 16. In the facing inner edges of the above U-shaped space 11' between the J-shaped plates 11, small projections 11*c* facing each other are formed on the plates 11 for receiving ends of a compression spring 17. The oval fuse plate 16 comprising a pair of component plates connected by a fusible metal to each other is provided with two holes 16*d* at positions corresponding to the bent ends 15 of the keying device 10 and is removably inserted and held between the bent ends 15. The compression spring 17 supported at both ends thereof by the projections 11*c* urges the keying device 10 to open as in FIG. 7, when the fuse plate is separated due to high ambient temperatures in case of a fire.

Figure 8:
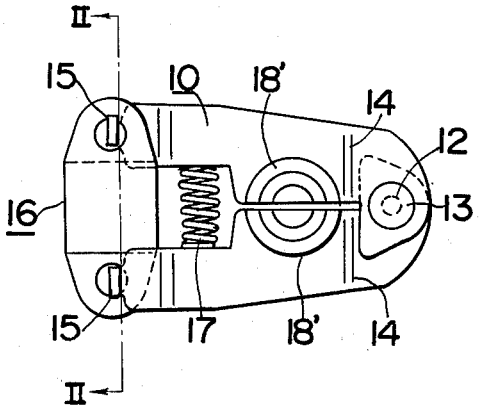
Figure 10:
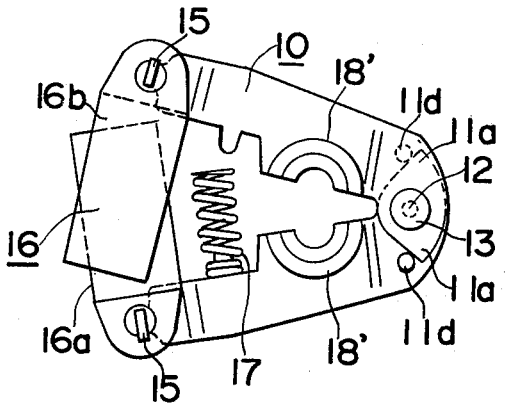
Figure 9:
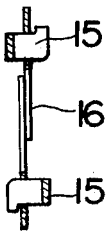
Figure 13:
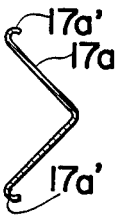
Figure 12:
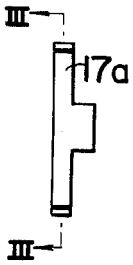
Figure 11:
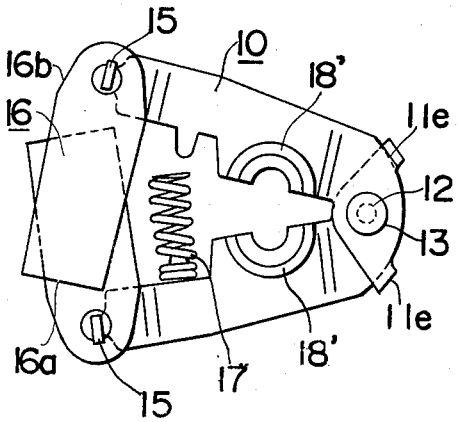
Figure 15:
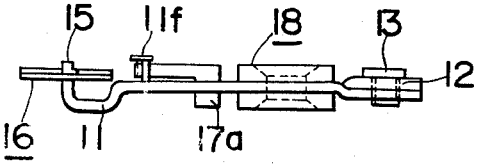
Figure 14:
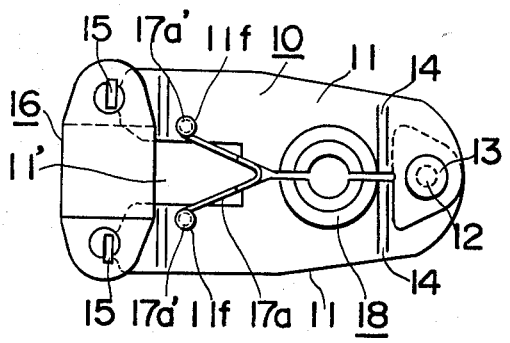

Referring now to FIGS. 8 through to 26 showing modifications for the keying device 10, the narrow rectangular ends 15 of the plates 11 which are described to be folded at right angles to the surfaces of the plates 11 in the same direction in the above embodiment are folded in the opposite directions to each other in a 1st modification shown in FIGS. 8 and 9. FIG. 10 shows a 2nd modification of the keying device, wherein a short pin 11*d* extending at right angles from the surface of each plate 11 is provided close to the tip of the corresponding angular portion 11*a* of the plate 11 so as to limit the opening of the keying device 10. In FIG. 11 showing a 3rd modification, the pivoted ends of the plates 11 are narrowed to form small rectangular portions 11*e* which extend to a certain extent beyond the round edges of the pivoted overlapping ends of the corresponding plates 11 and are folded at right angles to the surfaces of the plates 11 in the opposite directions to each other so that the inner faces of the folded portions 11*e* contact the corresponding round edges of the plates 11 to limit the opening of the keying device 10. In a 4th modification of the present invention shown in FIGS. 12 to 15, a V-shaped leaf spring 17*a* (FIGS. 12 and 13) is adopted which is removably attached, at the rounded ends 17*a'* thereof, to pins 11*f* (FIGS. 14 and 15), each extending outwardly in the same direction at right angles from the surface of the plate 11 at a position close to the edge of the U-shaped space 11' between the plates 11.

Figure 16:
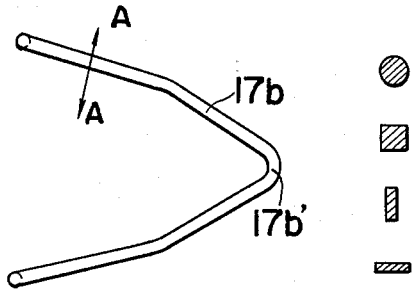
Figure 17:
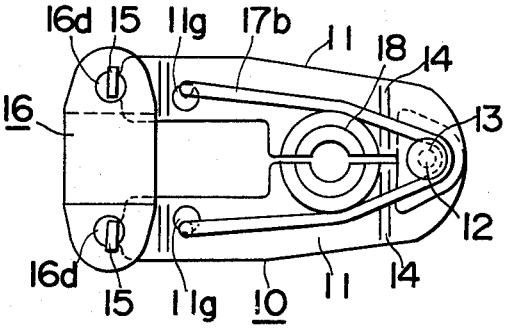
FIG. 17 is a top plan view of the 5th modification of the keying device.
Figure 18:
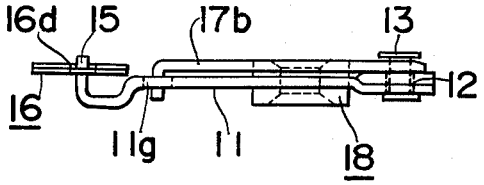
FIG. 18 is a side elevational view of the keying device in FIG. 17.

In a 5th modification shown in FIGS. 16 to 18, a wire spring 17*b* of V-shape (FIG. 16(*a*)) which is bent at both ends at right angles to the axis of its wire is employed. A small opening 11*g* is formed in each plate 11 adjacent to the tip 15 thereof. The pin 13 for pivotally connecting the plates 11 is slightly raised from the surface of the upper plate 11 so that the pointed portion 17*b'*of the V-shaped wire spring 17*b* engages therewith. The two sides of the V-shaped wire spring 17*b* are slightly bent inward at positions to hold the washer 18 therebetween and the bent ends of the spring are inserted into the openings 11*g* as in FIG. 17. The cross section taken along the line A—A in FIG. 16(*a*) may be of any form as shown in FIG. 16(*b*).

Figure 19:
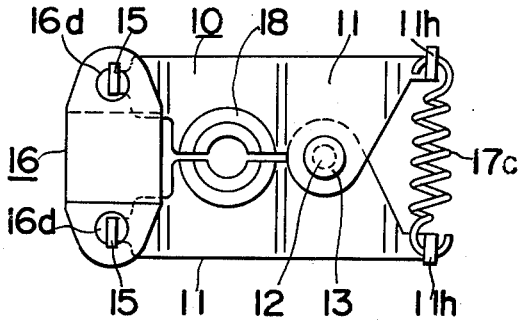
FIG. 19 is a top plan view of a 6th modification of the keying device.
Figure 20:
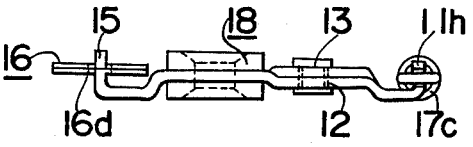
FIG. 20 is a side elevational view of the keying device in FIG. 19.

It should be noted that in the modifications so far described the springs 17, 17*a* and 17*b* are mounted on the keying device 10 in the compressed state irrespective of the shape of the spring so as to urge the keying device 10 to open, whereas the modifications hereinbelow described employ springs in a state of extension so as to urge the keying device 10 to open in the similar manner as above. In a 6th modification shown in FIGS. 19 and 20, the ends of the plates 11 remote from the folded ends 15 are further extended beyond the pin 13 and narrowed at the extreme ends to form corresponding small rectangular ends 11*h*. The rectangular ends 11*h* are bent at right angles to the surfaces 11 in the same direction and provided with U-shaped notches in the sides thereof opposite to each other for receiving ends of a coil spring 17*c* which is extended between the ends 11*h* to urge the plates 11 to open relative to the pin 13. The keying device shown in a 7th modification in FIGS. 21 to 24 is similar in construction to the one in the above 6th modification, but the rectangular ends 11*i* of the plates 11 remote from the other ends 15 are somewhat longer and wider than those in FIG. 19, forming a U-shaped space therebetween adjacent to the pin 13, and a pin 11*j* extending at right angles from the surface of the plate 11 is fixedly provided close to the inner corner of each rectangular end 11*i*. An M-shaped leaf spring 17*d* suitably narrowed at leg portions 17*d'* and rounded at the extreme ends of the leg portions 17*d'* is removably mounted on the keying device 10 with the rounded ends engaging the pins 11*j* and the broad back 17*d''* of the spring 17*d* pressed against the edge of the U-shaped space adjacent to the pin 13 as in FIGS. 23 and 24. In an 8th modification shown in FIGS. 25 and 26, wherein a pair of pawls are employed instead of the pivot pin the extreme ends of the plates 11 remote from the other ends 15 are formed into small rectangular ends which are further bent in the opposite directions to each other to form small U-shaped pawls 11*k*. The pawls 11*k* alternately engage to each other at corresponding side edges thereof as in FIG. 26 so that both plates 11 can be opened or closed relative to the engaging side edges of the pawls 11*k*.

It should be noted that eight modifications of the keying device as described above are the exactly the same in function and method of attachment as the keying device in the first embodiment employed in the door closing mechanism in FIG. 1 and can also be applied to a 2nd example of door closing mechanism which will be taken up later.

Referring to FIGS. 27 and 28, the fuse plate 16 of the present invention comprises two fuse element plates 16*a* and 16*b* of D-shape, each formed with the hole 16*d* at the round side thereof, and bent at a portion between the hole 16*d* and the edge on the other straight side thereof to form a triangle portion 16*c*. The triangle portions 16*c* on each of the plates 16*a* and 16*b* are adapted to overlap each other with contact surfaces 16*d* thereof soldered by a fusible material to form a single fuse plate 16. The plate 16*b* is identical with the plate 16*a* in the angle of bend at the portion 16*c*, but has a narrow flat portion 16*e* adjacent to the straight edge thereof for better contact with the upper surface of the plate 16*a* when overlapped. When an external force is applied in the directions of C and C' to the fuse plate 16 so as to separate the plates 16*a* and 16*b* with elevated temperatures higher than a melting point of the fusible material, a moment for separation in the directions of D and D' which arises from the angle of bend $\theta$ of the plates 16*a* and 16*b* and the difference in thickness 20 therebetween causes the fuse 16 to be separated into the element plates 16*a* and 16*b* with the melting of the fusible material between the contact surfaces 16*d* of the plates 16*a* and 16*b*.

Referring to FIGS. 29, 30 and 31, in order to determine the optimum angle of bend $\theta$ so that the fuse plate 16 has the easiest separation in case of a fire as well as high tensile strength at normal condition, tensile test and fusion test of sample fuse plates were carried out at temperatures between 70°C and 75°C with a tensile force of 8 Kg. Sample fuse plates S of the same dimensions with different angle of bend $\theta$ were inserted at one hole thereof into a pin P one by one, each being pulled at the other end thereof by a tensile force F of 8 Kg. with time required for separation of the sample fuse plate measured. As is seen from FIG. 31, the optimum angle of bend $\theta$ has been found to be between 7° and 15° as a result of the above tensile and fusion tests.

It should be noted, however, that various modifications can be made to the fuse plate as shown in FIGS. 32 to 41. The modification in FIG. 32 has an angular portion 16*c*, but the contact surfaces 16*d* are limited to the front portion of the triangular form. In FIGS. 33 and 34, the contact surfaces 16*d* are curved to form a semi-circle or wave shape, while one in FIG. 35 is of flat contact surfaces. In FIGS. 36 to 39, cross sections are similar to those in FIGS. 32 to 35, but one or more protuberant portions P are provided on one of the plates 16*a* or 16*b* to form contact between the two plates, and the small space 16*c* between the two plates 16*a* and 16*b* thus formed should preferably be filled by the fusible material for higher tensile strength in the normal conditions.

Referring now to FIG. 40, notches 16*d'* are formed on the fuse plate 16 to facilitate the mounting thereof to the bent ends 15 of the keying device 10 instead of the holes 16*d* described as effected in the above modifications. In FIG. 41, the ends 15 of the plates 11 of the keying device 10 are folded outwardly in the opposite direction to each other to form U-shaped pawls 15' as in FIG. 42, while the round edges of the fuse plate 16 also bent inwardly to form U-shaped portions 16*e* to catch the tips of the pawls 15', thus holes 16*d* described as effected in the 1st embodiment being dispensed with.

It should be noted that the various modifications of the fuse plates described in FIGS. 32 to 40 are approximately the same in function and can be mounted to the keying device 10 in FIGS. 1 to 8 and the modifications thereof described in FIGS. 8 to 26.

Referring back to FIGS. 1 to 3, the keying device 10 of the present invention with the above fuse plate 16 mounted between the bent ends 15 thereof is inserted into the securing screw 20 on the plate spring 21 through the washer 18 of the keying device 10 which is sandwiched by a pair of tapered cone washers 19 at the countersunk portions on both faces of the washer 18 and is pressed against the plate spring 21 as the nut 22 is tightened. As the straight end of the plate spring 21 engages the upper groove 23*a* of the pin 23, the pin 23 is pressed down with the roller 24 provided at the lower end thereof depressing the surface of the concave groove of the roller support 25 fixed on the door closer 7, thus the door 4 is kept in the fully opened position 4*a* as described earlier.

Figure 1:
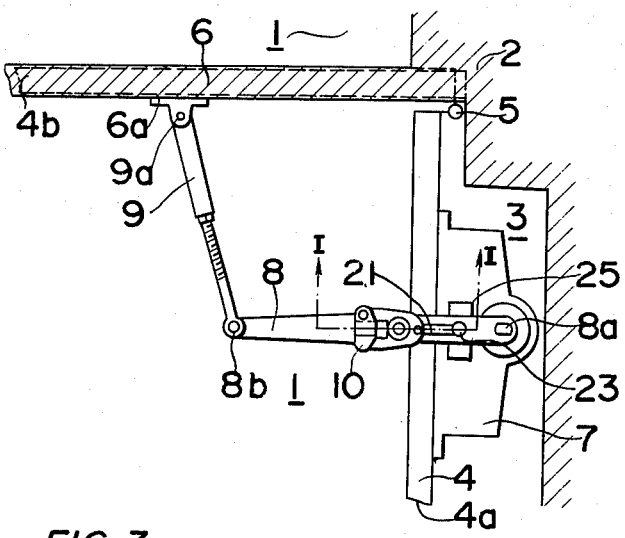
Figure 3:
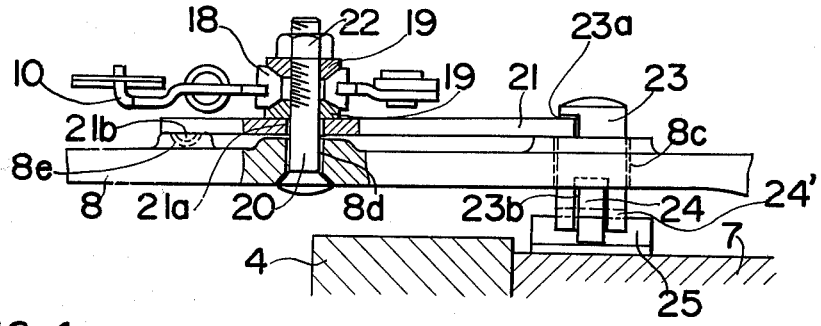
Figure 4:
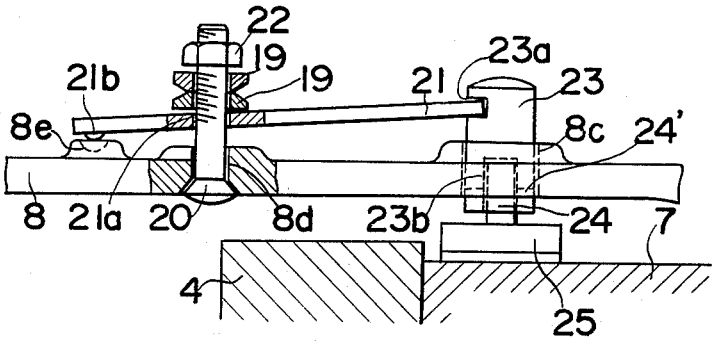

By this arrangement, in the normal condition shown in FIGS. 1 to 3, wherein the fire door 4 is in the fully opened position 4*a* and kept in the door case 3, no loosening arises at the sliding faces between the countersink of the washer 18 and the taper portions of the pair of cone-shaped washers 19 as the keying device 10 remains closed so long as the fuse plate 16 is not separated at the soldered contact surfaces by the melting of the fusible material due to high ambient temperatures. Accordingly, no slackening of the plate spring 21 is caused with the roller 24 pressed against the concave groove of the support 25, thus maintaining the fire door 4 in the fully opened position 4*a*.

Referring back to FIG. 4 and 7, in case of a fire, the fusible material of the fuse plate 16 begins to melt due to elevated ambient temperatures while the rebounding force of the compression spring 17 expedites the separation of the fuse plate 16 and consequently the opening of the J-shaped plates 11 of the keying device 10 relative to the pin 13 to such an extent that the pointed tips of the angular portions 11*a* of the J-shaped plates 11 contact the corresponding step portions 14 so as to limit the further opening of the J-shaped plates 11 and to prevent the keying device 10, with the half washers 18' thereof sandwiched between the cone shaped washers 19, from falling off the securing screw 20 in the arm 8, except for the fuse plate 16. In the meantime, the tapered faces of the cone-shaped washers 19 slide down the countersunk faces of the half washers 18', resulting in the loosening therebetween. Accordingly, the plate spring 21 is relieved from the depressed state with the roller 24 of the pin 23 tending to rise from the surface of the concave groove of the support 25. As the support 25 fixed on the door closer 7 tends to move in the direction to close the door 4 by the spring force of the door closer 7 urging to close the door 4, the roller 24 goes over the convex edge of the concave groove of the support 25 as the arm 8 rotates so as to close the door 4.

Referring now to FIGS. 43 to 45, a second example of door closing mechanism for a door assembly to which the keying device 10 with the fuse plate 16 of the present invention is applicable comprises a fire door 4 hingedly supported at 5 on a wall 2 in a passage 1 and a door closer 7 fixed to the upper side of the door 4 with pivotal connections to the stationary upper frame 6 secured to the wall 2 through an arm 8 and a link bar 9 so that the fire door 4 can be rotated relative to the hinge 5 between the fully opened position 4*a* and a fully closed position 4*b* below the stationary upper frame 6 fixed to the walls in the similar manner as in the first example. In this example, the keying device holder H is fixed to the fire door 4 at a position suitable for maintaining the fire door fully open, for example, adjacent to one side of the fire door 4 remote from the hinge 5 as shown in FIG. 43.

The keying device holder H further comprises an cylindrical sleeve 108*a* having one open end with the other flanged end thereof provided with a small opening 109 in its center for inserting a securing screw 190 therethrough. The inner surface of the 108*a* is threaded to receive another sleeve 108*b*. The sleeve 108*b* with both ends open having a flange portion at one end thereof is provided with a threaded outer surface with diameter that can be engaged with the threaded inner surface of the sleeve 108*a*. A center shaft 111 is slidably inserted through the opening 110 at the flange side of the sleeve 108*b*. Approximately one half of the center shaft 111 is formed into a stem portion with a reduced diameter and is provided with a threaded hole 111*a* in the direction of its axis to receive the securing screw 190 while the other end of the shaft 111 is loosely connected by a snap ring or the like to an attraction plate 115 through a hole formed in the plate 115. A compression spring 117 is provided between the stem portion of the reduced diameter of the center shaft 111 and the inner face of the sleeve 108*a* adjacent to the opening 109 thereof.

In attaching the keying device holder H to the door 4, opening 107*a* and 107*b* are formed in the suitable place in the door 4, through which the sleeve 108*a* and 108*b* are inserted and threaded together. The center shaft 111 with the reduced diameter stem portion thereof supporting one end of the compression spring 117 is inserted through the opening 110 in the sleeve 108*b*. The securing screw 190 with oval tapered head is inserted through the countersunk washer 18 of the keying device 10, the opening 109 of the sleeve 108*a* and the other end of the compression spring 117, into the threaded hole in the reduced diameter stem portion of the center shaft 111 and is tightened, compressing the spring 117. A magnet plate 118 provided with a bracket 120 is rigidly fixed to the wall 2 in the door case 3 at a position corresponding to the attraction plate 115. The distance between the attraction plate 115 on the door 4 and the magnet plate 118 can be adjustably by turning the securing screw 190. The compression spring 117 can be replaced depending on the thickness of the fire door 4.

In this arrangement, when the door 4 is in the fully opened position 4*a* shown in real line in FIG. 43, the attraction plate 115 is strongly attracted by the magnet 118, keeping the fire door 4 in the fully opened position 4*a*. It should be noted that the attraction force of the magnet 118 is stronger than the force of the spring 7*b* (FIG. 2) of the door closer 7 urging to close the fire.

In case of a fire when the fusible material between the contact surfaces of the fuse plate 16 melts due to high ambient temperatures, causing the plate 16 to be separated into the two component plates 16*a* and 16*b* in the manner as described earlier, the tapered portion in the head of the screw 109 slips off the countersink of the washer 18 into the opening 109 of the sleeve 108*a* as the countersunk washer 18 is split into two component half washers 18'. Accordingly, the door 4 is pushed in the direction to close the door 4 by the spring force of the compression spring 117 with the sleeve 108*a* and 108*b* remaining attached thereto, leaving the attraction plate 115 together with the center shaft 111, the securing screw 190 and the spring 117 attracted by the magnet plate 118 fixed on the wall 2. Thereafter, the door 4 is rotated to the fully closed position 4*b* in FIG. 43 by the action of the door closer 7.

It should be noted that the various modifications for the keying device of the present invention can be applied to the 1st and 2nd examples of the door closing mechanism shown in FIG. 1 and FIG. 43 respectively as well as to any other door closing mechanism which does not depart from the scope of the present invention.

From the foregoing description, it has now become clear that the temperature actuated keying device of the present invention has rapid and stable response to the increase of ambient temperatures particularly in case of a fire, thus enabling the door to be positively closed, while in the normal condition, it securely keeps the door in the fully opened position without any danger which may be caused by unexpected closing of the door.

The provision of a fuse plate with an improved angle of bend together with spring means employed in the keying device for easy opening thereof is very effective in achieving above quick and stable response of the keying device in an emergency, while in the normal condition the fuse plate has sufficient tensile strength to stand the spring force of the door closer urging the door to be rotated in the direction of closing.

Furthermore, since the fuse plate is removably attached to the keying device whose degree of opening is limited by the provision of the step portions, the keying device remains on the securing screw at the countersunk washer portion thereof even after the keying device is actuated due to an elevated ambient temperature in case of emergency, thus making it possible to reuse the device repeatedly by the mere replacement of the fuse plate.

Although the present invention has been fully described by way of example with reference to the attached drawings, it is to be noted that various changes and modifications are apparent to those skilled in the art. For example, the fuse plate described as mounted on the keying device in the preferred embodiment can be replaced by a length of fuse in the form of a wire wrapped several times around the ends 15 of the keying device. Therefore, unless otherwise such changes and modifications depart from the scope of the present invention, they should be construed as included therein.

What is claimed is:

1. A temperature actuated keying device comprising a pair of clamping members consisting of plates pivotally connected to each other at overlapping ends thereof, each of said clamping members having a countersunk half washer fixed at a corresponding inner edge thereof between the ends of the plates and adapted to form one countersunk washer when said clamping members are pivoted to a closed position, means supported by said clamping members for biasing the other ends of said clamping members toward an open position, and a pair of component plates connected by a fusible material to form a single fuse plate connected with the other ends of said clamping members for acting against said biasing means, a securing screw through said countersunk washer, at least one cone washer on said screw in contact with said countersunk washer, and a plate spring means in contact with said at least one cone washer for allowing a door to be moved to a closed position when said clamping members are biased into the open position.

* * * * *